US005436703A

United States Patent [19]

DeYoung et al.

[11] Patent Number: 5,436,703

[45] Date of Patent: Jul. 25, 1995

[54] DEVELOPMENT UNIT FOR ELECTROSTATOGRAPHIC PRINTING HAVING A SPILLOVER BARRIER FOR USED DEVELOPER MATERIAL

[75] Inventors: Victoria F. DeYoung, Rochester; Cyril G. Edmunds; Jorge A. Alvarez, both of Webster, all of N.Y.

[73] Assignee: Xerox Corporation, Stamford, Conn.

[21] Appl. No.: 236,080

[22] Filed: May 2, 1994

[51] Int. Cl.[6] ..... G03G 15/06

[52] U.S. Cl. ..... 355/245; 118/653

[58] Field of Search ..... 355/245, 246, 260; 118/653; 222/DIG. 1

[56] References Cited

U.S. PATENT DOCUMENTS

| | | | |
|---|---|---|---|
| 4,614,165 | 9/1986 | Folkins et al. | 118/657 |
| 4,891,673 | 1/1990 | Buell | 355/245 |
| 5,095,338 | 3/1992 | Hayes, Jr. et al. | 355/246 |
| 5,235,391 | 8/1993 | Aimoto | 355/245 X |
| 5,250,749 | 10/1993 | Aimoto | 118/653 |
| 5,335,051 | 8/1994 | Tani | 355/245 |

FOREIGN PATENT DOCUMENTS

| | | | |
|---|---|---|---|
| 63-18374 | 1/1988 | Japan | 355/260 |
| 2-21591 | 5/1990 | Japan . | |

*Primary Examiner*—A. T. Grimley
*Assistant Examiner*—William J. Royer
*Attorney, Agent, or Firm*—R. Hutter

[57] ABSTRACT

A development unit for electrostatic printing is designed to eliminate used developer at a steady rate. A barrier mounted in the housing defines in the housing a first chamber adapted to store a supply of developer material therein, and a second chamber adapted to receive excess developer material from the first chamber of the housing. A transport is mounted in the second chamber, for advancing developer material from the barrier.

8 Claims, 2 Drawing Sheets

DEVELOPMENT UNIT FOR ELECTROSTATOGRAPHIC PRINTING HAVING A SPILLOVER BARRIER FOR USED DEVELOPER MATERIAL

This application incorporates by reference U.S. Pat. No. 4,614,165, assigned to the assignee hereof.

The present invention relates to a development unit for use in an electrostatographic printer.

In the process of electrostatographic printing, a charge-retentive surface, also known as a photoreceptor, is charged to a substantially uniform potential so as to sensitize the surface thereof. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the image. This developed image on the photoreceptor is subsequently transferred to a sheet on which the desired image is to be printed. Finally, the toner on the sheet is heated to permanently fuse it to the sheet in image configuration.

One familiar type of development of an electrostatic image is called "two-component development." Two-component developer largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere as desired to the electrostatic latent image.

Despite the practical advantages of two-component development, which has caused this type of development to become very common in printers and copiers available today, a common problem involving two-component development relates to the degradation of two-component developer material, that is the mixture of carrier and toner, over the life of a printer or copier. One print quality problem results from the fact that, whereas the toner in developer material is gradually consumed by being placed on the photoreceptor and then from the photoreceptor on to a print sheet with successive prints, a constant quantity of carrier particles remains in the system; the long-term result is that the ratio of toner to carrier particles in the developer mixture drifts from an optimal level. Further, the frequency of print quality defects tends to increase with the increasing length of service of a two-component development system. Such print quality defects may be caused by dirt generation from developer material which is nearing the end of its useful life. At service calls, however, developer material is frequently changed without knowing the condition thereof, which can result in an effective wasting of developer material.

U.S. Pat. No. 4,614,165, assigned to the assignee hereof and incorporated by reference herein, discloses the general principle of what is known familiarly as "trickle" development. Very briefly, trickle development involves providing two distinct supplies of developer: a main supply, from which the development unit draws developer for application to the electrostatic latent image, and a second, separate developer supply which is used to replenish the first supply over time. Typically, the two quantities of developer have substantially different ratios of toner to carrier. In the embodiment described in the '165 patent, for example, the first developer supply in the housing of the development unit is 96% carrier by weight and 4% toner by weight, while the developer material being gradually dispensed into the first supply is 25% carrier by weight and 75% toner by weight. The idea is that, over the course of the lifetime of the printer, or at least of the development unit, the relatively toner-rich developer in the second supply is gradually discharged, or caused to "trickle," into the first developer supply. This trickling serves to maintain a substantially continuous replenishment of toner and carrier, thereby extending the useful life and the optimal print quality associated with the development unit.

In a trickle development system, even as a fresh supply of developer is discharged into the housing of the development unit, it is typically necessary that a similar quantity of surplus developer be permitted to be discharged from the housing of the development unit. The rate of input of fresh developer from the second supply must be fairly carefully matched to the output of "waste" developer out of the development unit, so that the effective ratio of toner to carrier within the main developer supply, which is being drawn upon for developing the latent images, is maintained within an optimal range. Therefore, a development unit must be designed to have a certain predetermined "capacitance" of developer.

Japanese examined patent publication JP-B2-2-21591 discloses a development unit wherein a "stirring means," in the form of a drum having longitudinal slots, is caused to rotate alongside a magnetic roll. A developer outflow aperture is disposed at a predetermined height relative to the stirring means, so that used developer is gradually and automatically discharged from the development unit at a predetermined rate.

According to one aspect of the present invention, there is provided a development unit for electrostatic printing. The development unit comprises a housing. A barrier mounted in the housing defines in the housing a first chamber adapted to store a supply of developer material therein, and a second chamber adapted to receive excess developer material from the first chamber of the housing. A transport is mounted in the second chamber, for advancing developer material from the barrier.

According to another aspect of the present invention, there is provided an electrostatographic printer, such as a copier, printer, or facsimile machine, comprising a charge-retentive surface and a development unit for applying developer to the charge-retentive surface. The development unit comprises a housing. A barrier mounted in the housing defines in the housing a first chamber adapted to store a supply of developer material therein, and a second chamber adapted to receive excess developer material from the first chamber of the housing. A transport is mounted in the second chamber, for advancing developer material from the barrier.

Figure 1:
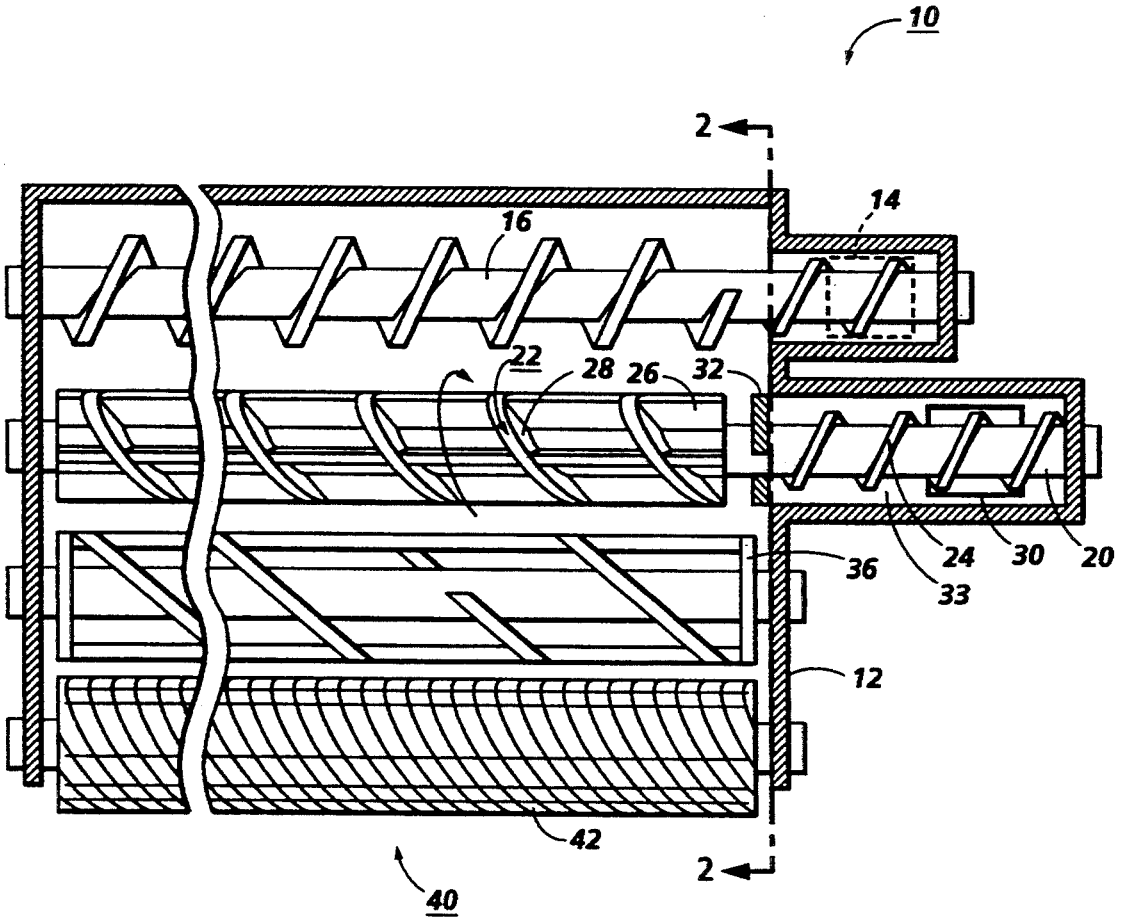
FIG. 1 is a plan view of a development unit incorporating the present invention.

FIG. 1 is a sectional plan view of the relevant portion of a development unit of the present invention. As is well-known in the art of electrophotographic printing, a development unit, such as indicated generally as 10, serves to retain a quantity of developer material (comprising toner plus carrier) for application to an electrostatic latent image on a charge-retentive surface, such as a photoreceptor. The development unit 10 shown in FIG. 1 includes a housing 12, which forms an enclosure to retain a supply of developer. The developer retained in the housing 12 at a given moment should be of a toner-carrier ratio (hereinafter "T/C") suitable for developing an electrostatic latent image. Although an optimal T/C will be very specific to a given printer or copier design, a typical T/C for a copier is about 96% carrier by weight to 4% toner by weight.

Development unit 10 includes an input port 14 defined in the housing 12 which receives an input of developer from an external source, in a manner which will be explained in detail below. This externally-provided developer, comprising toner and carrier, drops through the input port 14 by gravity and is then caught by an auger 16, which, when rotated (by means not shown) causes the developer from the input port 14 to be drawn longitudinally along the auger 16, to be distributed substantially evenly along the length of the auger 16 within housing 12.

Disposed alongside and adjacent the auger 16 is a rotatable member indicated generally as 20. The rotatable member 20 defines two relevant portions along its length: an agitator portion 22, and an auger portion 24. The agitator portion of rotatable member 20 is disposed along the main width of the development unit 10, so that the agitator 22 is generally alongside the auger 16. In a preferred embodiment of the present invention, the agitator 22 includes a combination of longitudinal fins 26 with a plurality of obliquely-disposed "wobble plates" 28.

Along another portion of the length of rotatable member 20 is an auger 24. The portion of rotatable member having auger 24 is restricted to an end section of the rotatable member 20, generally away from the main width of the development unit 10 and the auger 16. When the rotatable member 20 is rotated in a particular direction, auger 24 draws material away form the main portion of development unit 10 and toward an outlet port adjacent the auger 24, which is in FIG. 1 indicated as 30. Auger 24 thus serves as a "transport" for excess developer material in the development unit 10.

Rigidly mounted within the housing 12 of development unit 10 is a barrier 32 which fits around a portion of the rotatable member 20 between the agitator 22 and the auger 24, effectively separating off a second chamber 33 from the rest of the development unit housing 12, which can be considered a first or main chamber; developer material in the main chamber of housing 12 is possibly available for application to a charge-retentive surface on a photoreceptor, in a manner which will be described in detail below. Although the barrier 32 is shown in FIG. 1 as having edges which contact the walls of housing 12, it is not necessary, according to the claimed invention, that the second chamber 33 be completely sealed along the bottom or sides of barrier 32 from the main chamber of housing 12; the barrier 32 could to some extent be free-standing, with some gap between its sides and the wall of housing 12. The barrier 32 is intended to define a predetermined dam height for retaining a preselected quantity of developer material within the housing 12, in a manner which will be explained in detail below.

Disposed alongside agitator 22 of rotatable member 20, on the side opposite that of auger 16, is a second agitator 36. According to a preferred embodiment of the present invention, the second agitator 36 may define both wobble plates and open fins, as shown. The purpose of the second agitator 36 is to introduce developer material to a magnetic roll 40, which is disposed parallel to the agitator 36. As is well-known in the art of electrophotographic printing, a magnetic roll typically includes a rotatable outer sleeve around a fixed magnetic assembly. When developer, comprising magnetically-attractable carrier particles, with toner particles adhering triboelectrically thereto, is brought into contact with the sleeve 42 of magnetic roll 40, the developer forms what is known as a "magnetic brush," similar to the brush-like filaments of iron filings attracted to a magnet, around the sleeve 42. As the sleeve 42 of magnetic roll 40 rotates and is brought into contact with a charge-retentive surface on a photoreceptor, the toner particles on the carrier particles are made available for electrostatic attraction to the charge-retentive surface, to develop the latent image.

Figure 2:
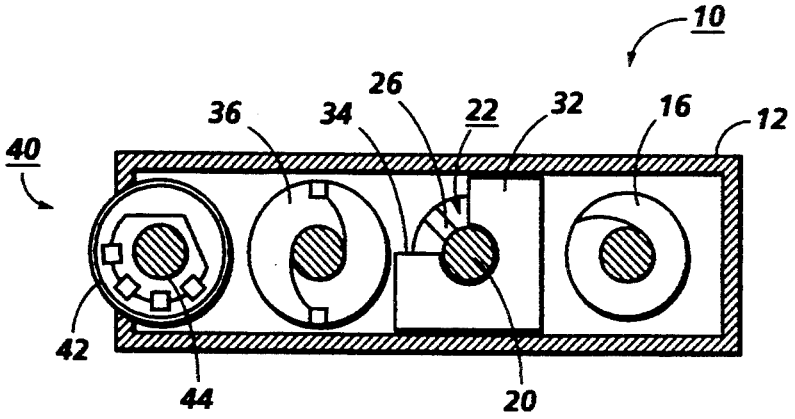
FIG. 2 is a sectional elevational view through line 2—2 in FIG. 1, of the development unit of the present invention.

FIG. 2 is a sectional elevational view, through line 2—2 in FIG. 1, showing the basic elements of the development unit 10 end-on. There can also be seen in the sectional view of FIG. 2 a stationary magnetic assembly 44 which is disposed within the rotatable sleeve 42 of magnetic roll 40. The barrier 32, as mentioned above, fits around a portion of the circumference of the rotatable member 20, and is located between the agitator 22 and the auger 24. One side of the barrier 32 defines a predetermined dam height indicated as 34. The dam height 34 has a direct effect on the amount and rate of developer material which will spill over the dam height 34, to be caught by auger 24 and removed from the development unit 10 through output port 30, as can be seen in FIG. 1. If the dam height 34 is too low, there will be an insufficient supply of developer within the development unit 10, causing poor copy quality; and if the dam height 34 is too high, there will be an excess of developer in development unit 10, causing compression of developer and possibly jamming of the various augers and agitators therein.

The dam height 34 of barrier 32 is preferably defined only on one horizontal side of the rotatable member 20, as shown, and on the horizontal side corresponding to an upward motion of a fin 26 of the agitator 22; the reason for this is, if the developer is constantly being pushed down by a downward motion of fin 26, the purpose of the dam height 34 will be confounded. Also, performance may be improved, in the sense of removing old developer before newer developer, if the dam height 34 is defined on the horizontal side of the rotatable member 20 away from the auger 16.

As will be apparent to one familiar with development units, the various rotating augers and agitators, along with the magnetic roll, in the development unit 10 may be driven by a single source of rotational motion and linked together by means (not shown) such as gears, belts, pulleys, linkages, or the like, which are preferably external to the housing 12.

Figure 3:
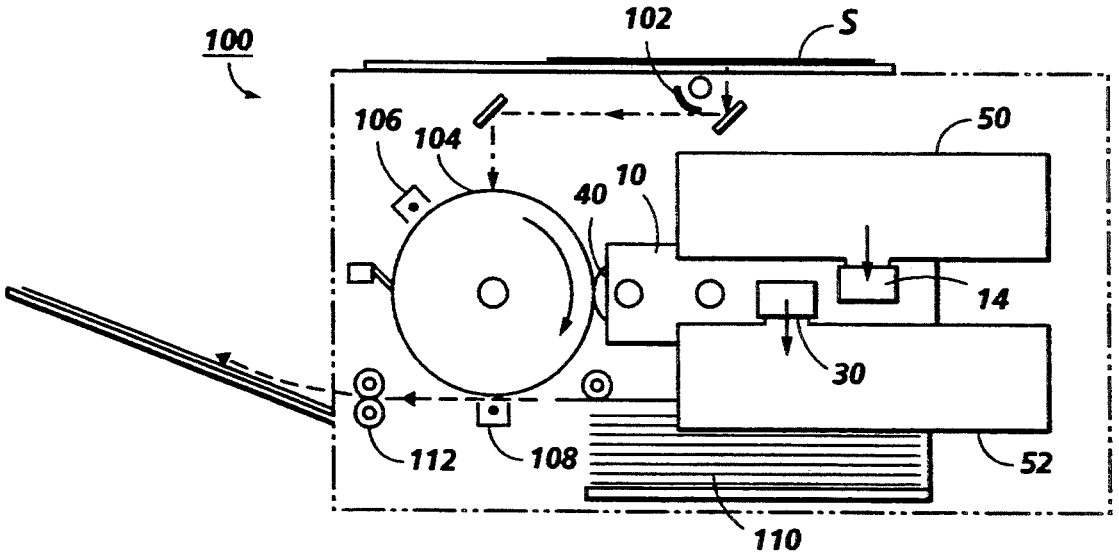
FIG. 3 is an elevational view showing the elements of an electrophotographic printer, in this case a copier, incorporating the present invention.

FIG. 3 is a simplified elevational view showing the basic elements of an electrostatographic printer, in this case a copier, incorporating the development unit of the present invention. The copier, generally indicated as 100, includes an exposure means 102, which may include a lamp, mirror, and self-focusing lens arrangement for obtaining an exposure of an original on sheet S to be copied. The image on sheet S is then exposed onto the surface of a photoreceptor 104 which has been previously charged by means of a corotron 106. When the charged surface of photoreceptor 104 is exposed to the image on sheet S, various portions of the surface will be discharged in imagewise fashion as they are exposed to light from the image. Those areas of the photoreceptor 104 which were not discharged in the exposure step are then developed by development unit 10, and in particular by the magnetic roll 40, so that toner is caused to adhere to the charged areas of photoreceptor 104, creating a "developed" image of the original. This developed image is then moved, by the rotation of photoreceptor 104, to a transfer station 108, where the toner on the photoreceptor is electrostatically transferred to a sheet of plain paper from stack 110. The sheet from stack 110 which receives the toner particles in imagewise fashion, is then sent through a fuser 112, which causes the toner particles to be melted onto the sheet to form a permanent image.

The development unit design of the present invention is particularly useful for development systems which utilize "trickle" development. As mentioned above, in trickle development, there is provided a main supply of developer, which is drawn upon for application to an electrostatic latent image on photoreceptor 104, and a second supply of developer, which gradually discharges, or trickles, into the main developer supply. In most embodiments of trickle development, the main and secondary supplies of developer have substantially different T/C's. With the development unit of the present invention, the main developer supply is retained in the housing 12 of development unit 10, while the secondary developer supply is discharged into the development unit 10 through input port 14. Simultaneously, in order to maintain both a relatively stable amount of developer in housing 12, and also to maintain the T/C of the developer in housing 12 within an optimal range, a certain quantity of developer is discharged through output port 30, which is adjacent auger 24. A key purpose of barrier 32, with its predetermined dam height 34, is to maintain a certain capacitance of developer in the development unit 10 for application to the photoreceptor 104.

In FIG. 3 can be seen, interacting with development unit 10, a developer supply cartridge 50 and a developer sump container 52. Developer supply cartridge 50 is designed to supply toner to input port 14 of development unit 10, while developer sump 52 is a container which receives used developer from output port 30. In a typical trickle-development arrangement, the developer in cartridge 50 will have a T/C of 25% carrier by weight and 75% toner by weight, while the developer in the development unit 10 will be maintained at a T/C of about 96% carrier by weight and 4% toner by weight. In a preferred embodiment of the present invention, developer supply cartridge 50 is intended to be selectably removable, with new cartridges being installable by an end user. It is also preferred that development sump 52 be selectably removable by the end user when it is full.

It will be apparent to one of skill in the art that either developer supply cartridge 50 or developer sump 52 could be provided with means to indicate whether one or the other is full or empty, and indicate this status to the user through an external control panel or on a screen of a controlling computer or terminal. Further, the development unit 10 itself could be provided with a print-count device, such as disclosed, for example, in U.S. Pat. No. 4,961,088, assigned to the assignee hereof. It may also be desirable to provide the development unit 10 as a selectably removable, customer-replaceable unit, or even provide a combination of a development unit such as 10 with a photoreceptor 104 and an associated assembly as a single selectably removable customer-replaceable unit.

Although, in the above-described embodiment of a trickle development system, it is intended that a secondary developer supply have a different T/C than the main developer supply within development unit 10, it is conceivable to provide a development unit according to the present invention wherein the developer being input into the development unit is of the same T/C as the developer already in the development unit, possibly with equal-rate displacement of input and output developer through the development unit 10. It is also conceivable that, instead of a developer being provided into input port 14, pure toner, with no carrier therein, be supplied into development unit 10. It is also possible to provide a development unit according to the present invention having two separate input ports, one for accepting pure toner, and another for receiving carrier particles in a controlled manner, so that the T/C of incoming developer can be controlled while the system is in use.

While the invention has been described with reference to the structure disclosed, it is not confined to the details set forth, but is intended to cover such modifications or changes as may come within the scope of the following claims.

We claim:

1. A development unit comprising:

a housing;

a barrier mounted in the housing to define a first chamber adapted to store a supply of developer material therein, and a second chamber adapted to receive excess developer material from the first chamber of the housing, the housing defining an outlet port in the second chamber thereof;

the barrier being of a preselected dam height with developer material in the first chamber exceeding the preselected height of the barrier spilling thereover into the second chamber;

a transport, mounted in the second chamber, for advancing developer material from the barrier, the transport moving the developer material to the outlet port; and a container adapted to discharge developer material including toner particles into the first chamber.

2. The development unit of claim 1, wherein the transport comprises an auger adapted to move developer material in the second chamber of the housing from the barrier to the outlet port.

3. The development unit of claim 2, further comprising an agitator mounted rotatably in the first chamber of the housing, the agitator being substantially co-axial with the auger.

4. The development unit of claim 3, wherein the barrier defines the dam height on only one horizontal side of the agitator.

5. An electrostatographic printing apparatus, comprising:

a charge-retentive surface; and a development unit for applying developer to the charge-retentive surface, comprising:

a housing;

a barrier mounted in the housing to define therein a first chamber adapted to store a supply of developer material therein, and a second chamber adapted to receive excess developer material from the first chamber of the housing, the housing defining an outlet port in the second chamber thereof; and a transport, mounted in the second chamber, for advancing developer material from the barrier the transport moving the developer material to the outlet port; and a container adapted to discharge developer material including toner particles into the first chamber.

6. The printing apparatus of claim 5, wherein the transport comprises an auger adapted to move developer material in the second chamber of the housing from the barrier to the outlet port.

7. The printing apparatus of claim 6, further comprising an agitator mounted rotatably in the first chamber of the housing, the agitator being substantially co-axial with the auger.

8. The printing apparatus of claim 7, wherein the barrier defines the dam height on only one horizontal side of the agitator.

* * * * *